US006894665B1

(12) United States Patent
Zimlich

(10) Patent No.: US 6,894,665 B1
(45) Date of Patent: May 17, 2005

(54) DRIVER CIRCUIT AND MATRIX TYPE DISPLAY DEVICE USING DRIVER CIRCUIT

(75) Inventor: David A. Zimlich, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 371 days.

(21) Appl. No.: 09/620,140

(22) Filed: Jul. 20, 2000

(51) Int. Cl.[7] ..... G09G 3/30

(52) U.S. Cl. ..... 345/76; 345/98; 345/100; 345/204

(58) Field of Search ..... 345/76, 77, 78, 345/74.1, 75.1, 75.2, 87, 98, 100, 204; 315/169.1, 169.3

(56) References Cited

U.S. PATENT DOCUMENTS

| | | | | | |
|---|---|---|---|---|---|
| 5,202,674 | A | * | 4/1993 | Takemori et al. | 345/75.1 |
| 5,205,770 | A | | 4/1993 | Lowrey et al. | 445/24 |
| 5,232,549 | A | | 8/1993 | Cathey et al. | 456/633 |
| 5,357,172 | A | | 10/1994 | Lee et al. | 315/167 |
| 5,459,480 | A | | 10/1995 | Browning et al. | 345/75 |
| 5,484,314 | A | | 1/1996 | Farnworth | 445/24 |
| 5,486,126 | A | | 1/1996 | Cathey et al. | 445/25 |
| 5,656,892 | A | | 8/1997 | Zimlich et al. | 315/169.3 |
| 5,773,927 | A | | 6/1998 | Zimlich | 313/495 |
| 5,796,375 | A | * | 8/1998 | Holloman | 345/75.2 |
| 5,814,946 | A | | 9/1998 | Hall et al. | 315/169.1 |
| 5,838,097 | A | * | 11/1998 | Kasanuki et al. | 313/495 |
| 5,844,370 | A | | 12/1998 | Cathey et al. | 315/169.1 |
| 5,857,884 | A | | 1/1999 | Zimlich | 445/24 |
| 5,867,136 | A | | 2/1999 | Zimlich | 345/74 |
| 5,894,235 | A | | 4/1999 | Zimlich | 327/91 |
| 5,898,428 | A | | 4/1999 | Zimlich et al. | 345/211 |
| 5,910,791 | A | | 6/1999 | Zimlich et al. | 345/74 |
| 6,014,122 | A | * | 1/2000 | Hashimoto | 345/98 |
| 6,094,689 | A | * | 7/2000 | Embry et al. | 710/5 |
| 6,107,999 | A | | 8/2000 | Zimlich et al. | 345/211 |
| 6,130,106 | A | | 10/2000 | Zimlich | 438/20 |
| 6,144,351 | A | | 11/2000 | Zimlich | 345/74 |
| 6,144,374 | A | * | 11/2000 | Hyun | 345/204 |
| 6,169,371 | B1 | | 1/2001 | Zimlich et al. | 315/169.1 |
| 6,169,528 | B1 | * | 1/2001 | Oguchi et al. | 345/74 |
| 6,195,076 | B1 | * | 2/2001 | Sakuragi et al. | 345/74 |
| 6,201,529 | B1 | * | 3/2001 | Shimizu | 345/150 |
| 6,288,695 | B1 | * | 9/2001 | Wood | 345/75.2 |
| 6,294,876 | B1 | * | 9/2001 | Ando et al. | 315/169.1 |
| 6,353,425 | B1 | * | 3/2002 | Mosier | 345/88 |
| 6,498,592 | B1 | * | 12/2002 | Matthies | 345/1.1 |
| 6,580,407 | B1 | * | 6/2003 | Suzuki et al. | 345/74.1 |
| 6,597,335 | B2 | * | 7/2003 | Yasunishi et al. | 345/89 |
| 2002/0154101 | A1 | * | 10/2002 | Abe et al. | |

* cited by examiner

*Primary Examiner*—Regina Liang
*Assistant Examiner*—Jennifer Nguyen
(74) *Attorney, Agent, or Firm*—Nixon & Vanderhye P.C.

(57) ABSTRACT

A driver circuit for driving signal lines of a matrix type display device includes pulsewidth modulation processing circuitry for generating pulsewidth modulated video data and driver circuitry for driving the signal lines in accordance with the pulsewidth modulated video data.

34 Claims, 11 Drawing Sheets

DRIVER CIRCUIT AND MATRIX TYPE DISPLAY DEVICE USING DRIVER CIRCUIT

BACKGROUND OF THE INVENTION

1. Technical Field

The present invention relates to a driver circuit for a matrix type display device such as a field emission display or a plasma display.

2. Background Description

Flat panel displays are widely used in a variety of applications, including computer displays. One type of flat panel display device that is well suited for such applications is the thin film field emission display device. Such flat panel displays seek to combine the cathodoluminescent-phosphor technology of cathode ray tubes with integrated circuit technology to obtain thin high resolution displays wherein each pixel is activated by its own electron emitter or set of emitters. Such field emission displays in elementary form include a generally planar substrate having an array of integral projecting emitters which are typically conical projections grouped into emitter sets. Depending upon the size and type of display, a conductive extraction grid is positioned above the emitters and driven at a positive voltage with the emitters selectively activated by providing a current path to ground with appropriate voltage differential between the emitters and extraction grid. The resulting electric field extracts electrons from the emitters. Moreover, the field emission display device additionally includes a display screen-anode formed from a glass plate coated with a transparent conductive material forming a relatively high positive voltage differential with respect to the cathode emitters. The display screen additionally includes a cathodoluminescent layer covering the conductive anode surface whereby emitted electrons are attracted by the anode and strike the phosphor layer to thus cause the emission of light at the impact site which in turn passes through the anode and glass plate. The luminescent level of the produced light is dependent upon the magnitude of the current flow to the emitters that is selectively controlled to produce a desired image.

Existing chips for driving field emission displays provide limited logic functionality and therefore offer only limited display resolution. For example, many conventional driver chips comprise transistors having a 3 micron gate length. Using such transistors, it is difficult to provide much logic functionality, particularly 8-bit logic functionality. One way to improve functionality is to provide additional logic circuits on the driver chips. However, the additional circuits unacceptably increase the size of the driver chips, making driver chips that provide 7- or 8-bit logic functionality impractical.

SUMMARY OF THE INVENTION

Therefore, it is seen to be desirable to provide an arrangement that provides for high improved logic functionality without a corresponding increase in the size of the driver chip.

In accordance with one aspect of the invention, a driver circuit for driving signal lines of a matrix type display device includes pulsewidth modulation circuitry for generating pulsewidth modulated video data and driver circuitry for driving the signal lines in accordance with the pulsewidth modulated video data.

The pulsewidth modulation circuitry (or pulsewidth modulation generator) provides a very dense logic that is "off chip" relative to the signal line driver circuit. This simplifies the design of the driver circuit and provides for high resolution display.

In accordance with another aspect of the present invention, a matrix type display device includes display elements connected to row lines and column lines. A driver circuit for driving said column lines includes pulsewidth modulation circuitry for generating pulsewidth modulated video data and driver circuitry for driving the column lines in accordance with the pulsewidth modulated video data.

Other features and advantages of the invention will become apparent from the detailed description of embodiments made hereinafter with reference to the accompanying drawings.

DETAILED DESCRIPTION

The present invention is described in the context of exemplary embodiments. However, the scope of the invention is not limited to the particular examples described in the specification. Rather, the description merely reflects certain practical and preferred embodiments, and serves to illustrate the principles and characteristics of the present invention. Those skilled in the art will recognize that various modifications and refinements may be made without departing from the spirit and scope of the invention.

Figure 1:
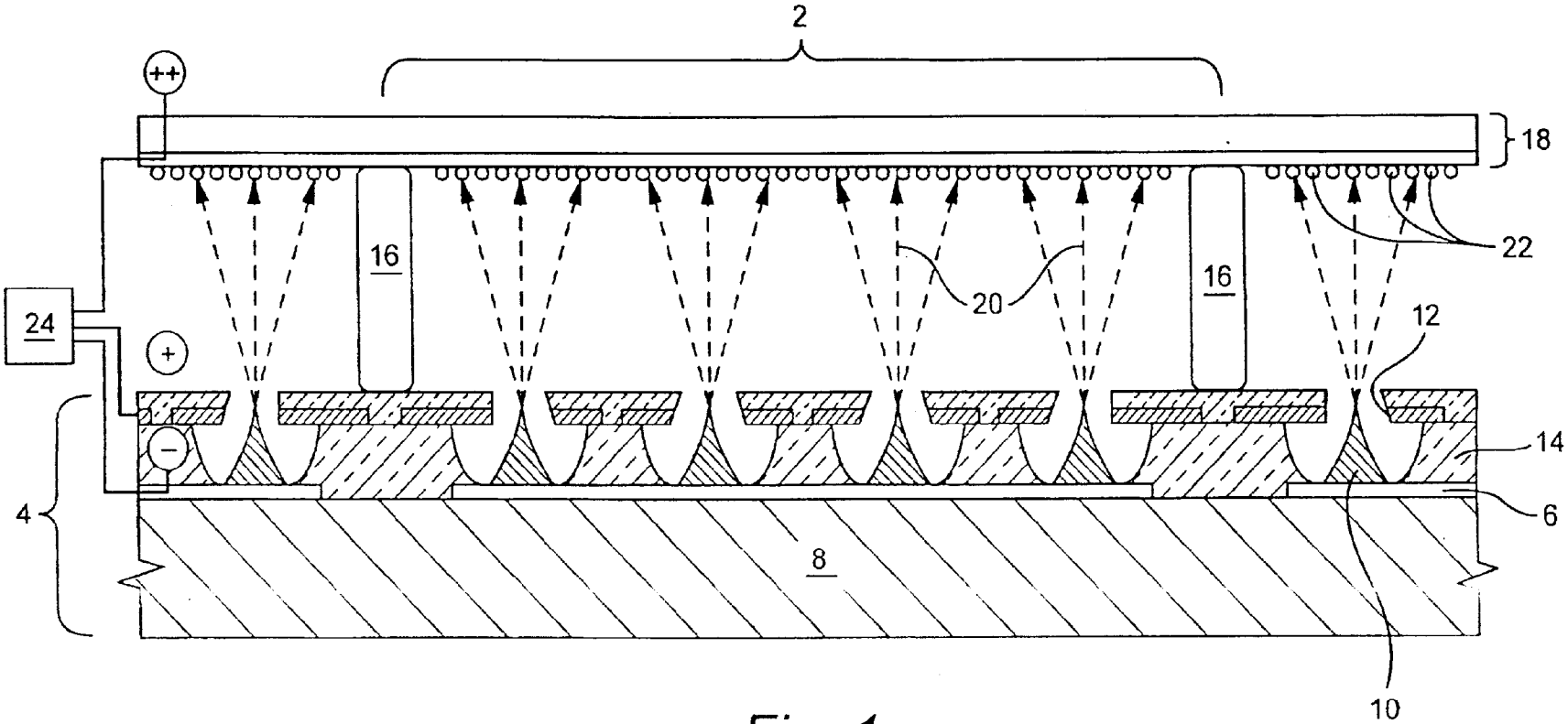
FIG. 1 is an illustrative cross-sectional schematic drawing of a flat panel field emission display.

FIG. 1 is a cross-sectional schematic of a portion of a flat-panel field emission display. In particular, a single display segment 2 is depicted. Each display segment is capable of displaying a pixel of information or a portion of a pixel as, for example, one green dot of a red/green/blue full-color triad pixel. A field emission display base assembly 4 includes a patterned conductive material layer 6 provided on a base 8 such as a soda lime glass substrate. The conductive material layer 6 may be formed, for example, from doped polycrystalline silicon and/or a suitable conductive metal such as chromium. The conductive material layer 6 forms base electrodes and conductors for the field emission device.

Conical micro-cathode field emitter tips 10 are constructed over the base 8 at the field emission cathode site. A base electrode resistive layer (not shown) may be provided between the conductive material layer 6 and the field emitter tips 10. The resistive layer may be formed, for example, from silicon that has been doped to provide an appropriate degree of resistance. A low potential anode gate structure or conductive grid 12 formed, for example, of doped polycrystalline silicon is arranged adjacent the field emitters 10. An insulating layer 14 separates the grid 12 from the base electrode conductive material layer 6. The insulating layer 14 may be formed, for example, from silicon dioxide.

Proper functioning of the emitter tips requires operation in a vacuum. Thus, a plurality of columnar supports 16 is provided over the base assembly 4 to support a display screen against atmospheric pressure. The columnar supports 16 may be formed in various ways including those described, for example, in U.S. Pat. No. 5,205,770; U.S. Pat. No. 5,232,549; U.S. Pat. No. 5,484,314; and U.S. Pat. No. 5,486,126. These patents are hereby incorporated by reference in their entirety.

In operation, the display screen 18 acts as an anode so that field emissions from the emitter tips 10, represented by arrows 20, strike phosphor coating 22 on the screen 18. The field emissions excite the phosphor coating 22 to generate light. A field emission is produced from an emitter tip when a voltage differential is established between the emitter tip and the anode structures. The emitters are two terminal devices behaving similar to a diode, conducting when forward biased beyond a positive threshold and not conducting under reverse bias. This drive scheme is useful for any passive matrix display.

In one arrangement, the conductive material 6 that forms the base electrodes forms a matrix of addressable nodes and the field emitters are addressed using both row and column driving circuits. In this arrangement, the patterned conductive material layer 6 preferably provides a matrix of base electrodes under the individual picture segments. The conductive grid 12 is maintained at a constant potential $V_{GRID}$. The present invention is applicable to a column driving circuit for such an arrangement.

The brightness of the light produced in response to the emitted electrons depends, in part, upon the rate at which electrons strike the cathodoluminescent layer. The light intensity of each pixel is controlled by controlling the current available to the corresponding emitters. To allow individual control of each of the pixels, the electric potential between each emitter set and the extraction gird is selectively controlled by a column line control signal and a row line control signal from corresponding driver circuits. To create an image, the driver circuits separately establish current to each of the emitter sets.

Figure 2:
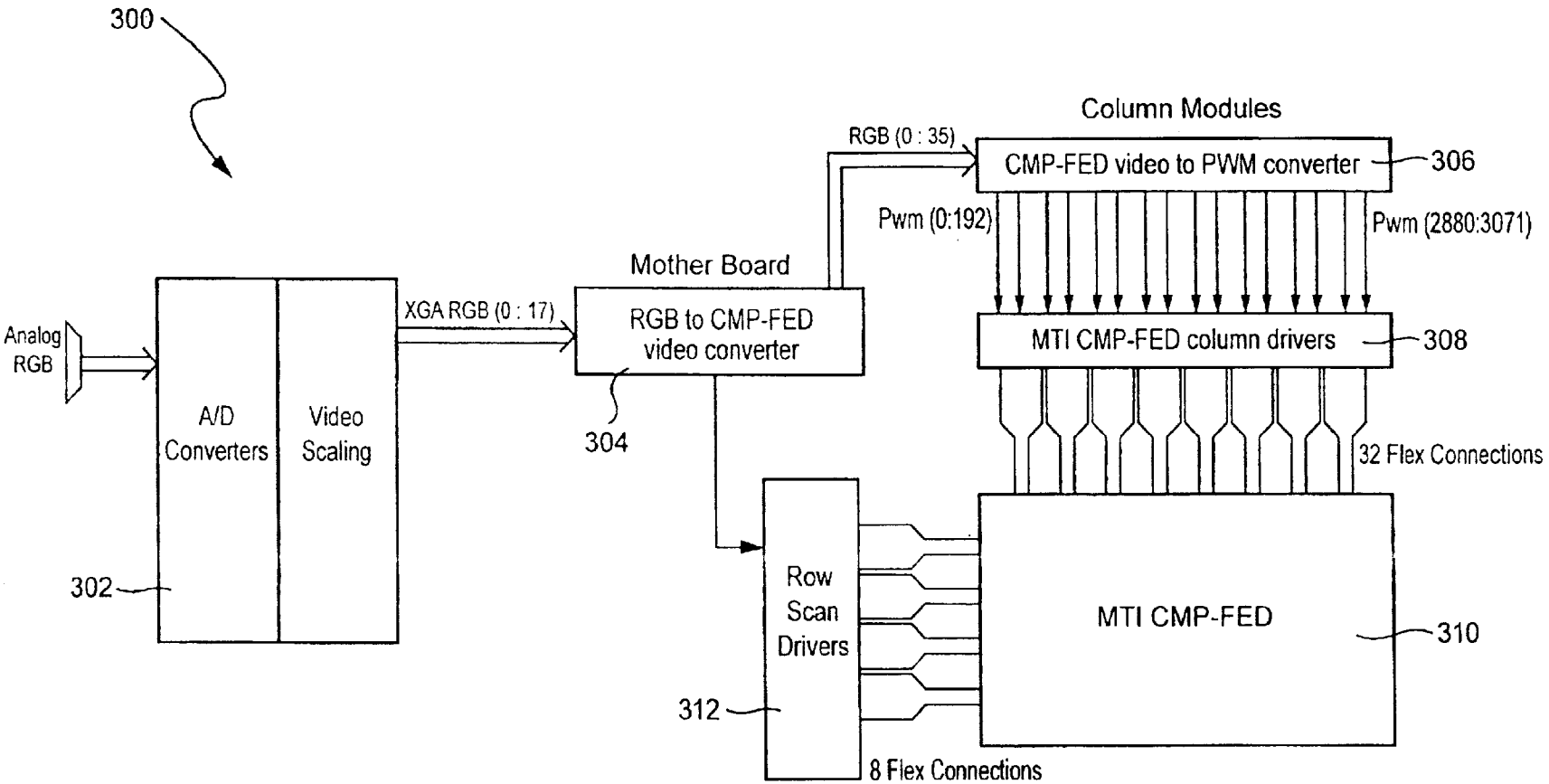
FIG. 2 is system block diagram of a field emission display 300 in accordance with one embodiment of the present invention.

FIG. 2 is system block diagram of a field emission display 300 in accordance with one embodiment of the present invention. First video circuitry 302 provides electronics for, for example, scaling, frame rate conversion and color depth processing of input RGB data as will be understood by those in the art. In the implementation shown in FIG. 2, first video circuitry 302 receives analog RGB data and outputs XGA (1024×768) RGB [0:17] data. The received analog RGB data may for example be analog RGB data associated with a display for personal or lap-top computer. First video circuitry 302 may also support SVGA (800×600) and VGA (640×480) resolutions. Suitable first video circuitry is a CHEETAH board available from Sage, Inc. of San Jose, Calif., although it will be appreciated that RGB to digital video processor/scalars are available from other vendors such as Genesis Microsystems, Inc. of Hartford, Conn.

The XGA RGB data from first video circuitry 302 is supplied to second video circuitry 304 for converting the XGA RGB data to field emission display (FED) video data. The output of second video circuitry 304 is supplied to pulsewidth modulation circuitry 306 for converting the FED video data to pulsewidth modulated (PWM) video data. The PWM video data is supplied to FED column driver circuitry 308 for driving the column lines of FED 310. Outputs from second video circuitry 304 are also supplied to row scan driver circuitry 312 for driving the row lines of FED 310.

Figure 3:
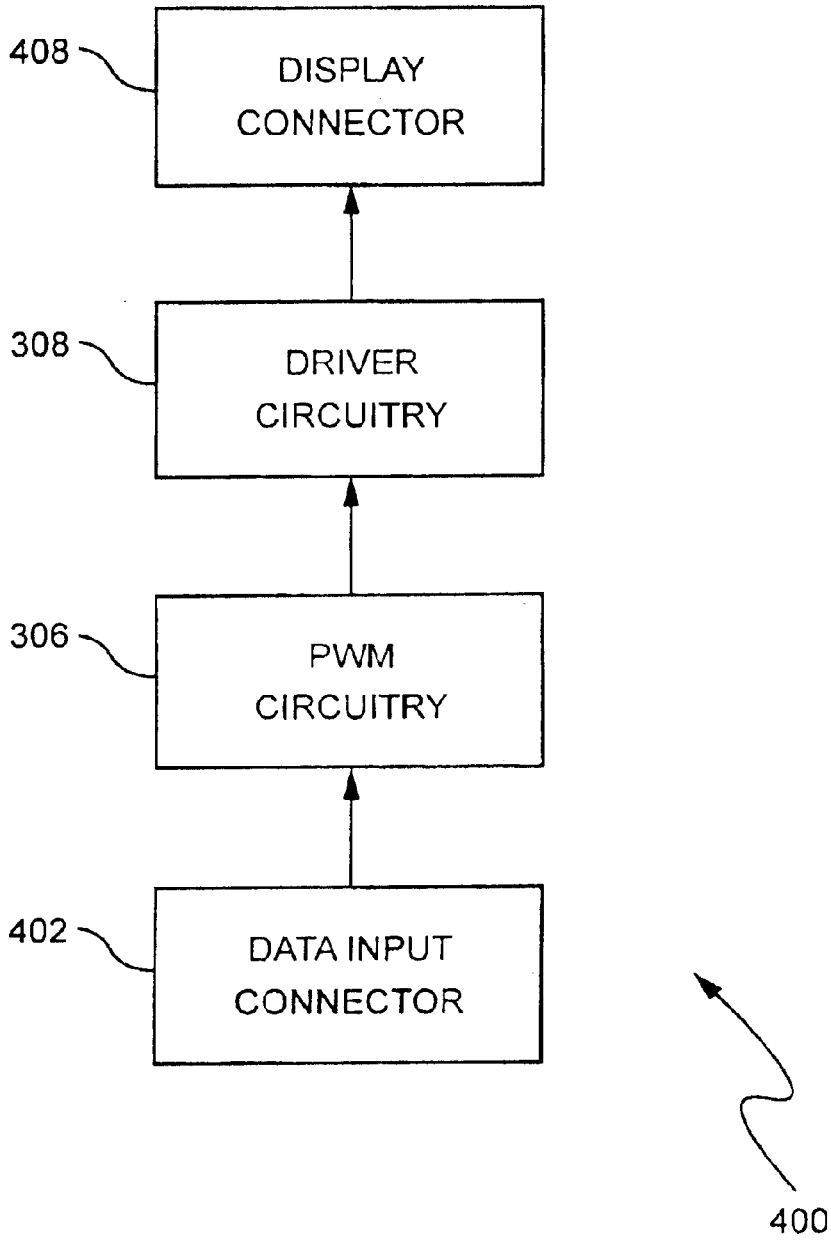
FIG. 3 is a block diagram of a column driver module 400 for use in the field emission display 300 of FIG. 2.

FIG. 3 is an overall block diagram of a column driver module 400. Column driver module 400 includes a data input connector 402, pulsewidth modulation circuitry 306, driver circuitry 308, and a display connector 408. Data input connector 402 receives the FED video data from second video circuitry 304 (see FIG. 2) and supplies this data to pulsewidth modulation circuitry 306. Pulsewidth modulation circuitry 306 converts the FED video data to PWM video data. This PWM video data is supplied to column driver circuitry 308. Driver circuitry 308 level-shifts the PWM video data and outputs the level-shifted data via display connector 408 as column signals to the column lines of the FED 310. The PWM video data comprises a pulsewidth that determines the "on-time" of the corresponding column line control signal. The maximum pulsewidth for the column line control signals is determined by the display resolution. For example, 8-bit resolution means that from 0 (dark) to 255 (maximum brightness) integer time segments may be supplied to the column lines. For example, if the "row time" is 25.6 microseconds with $2^8$ levels (0 to 255), then one pulsewidth is equal to 100 nanoseconds. Accordingly, gray level 1=100 nanoseconds pulsewidth; gray level 2=200 nanoseconds pulsewidth; etc.

Figure 4:
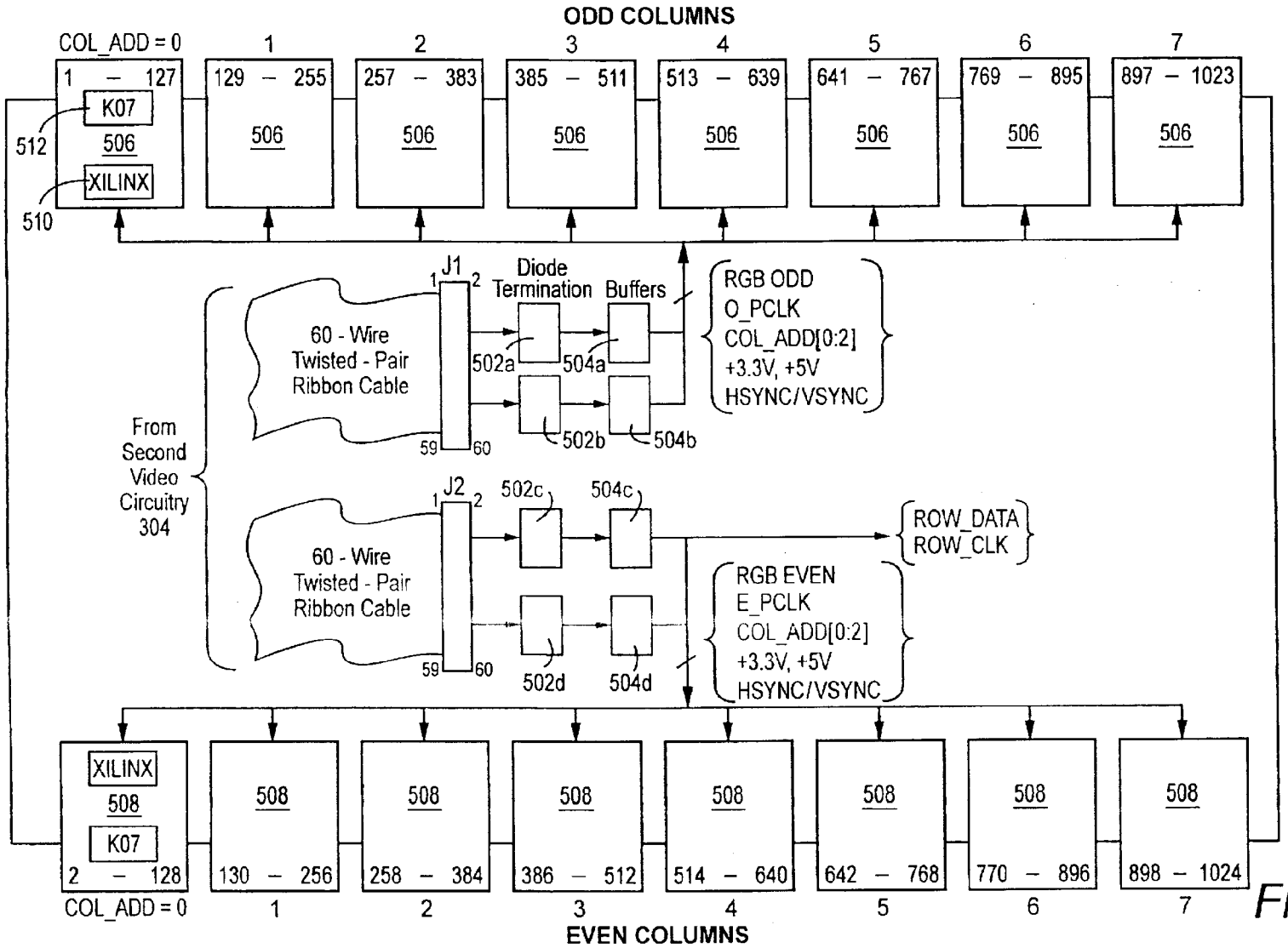
FIG. 4 is a more detailed block diagram of column driver module 400.

FIG. 4 is a more detailed block diagram of column driver module 400. Two 60-wire twisted-pair ribbon cables supply signals from the second video circuitry 304 to jumpers J1 and J2. These signals pass through diode termination circuits 502*a–d* and buffers 504*a–d*. The output of buffers 504*a*, 504*b* includes RGB odd signals, an O_PCLK (odd pixel clock) signal, col.add[0:2], +3.3 V, +5 V, and HSync/VSync signals. The output of buffers 504*c*, 504*d* include Row_Data and Row_Clk signals, RGB even signals, E_PCLK (even pixel clock), Col.add[0:2], +3.3 V, +5 V and HSync/VSync signals. The col.add[0:2] signals from the buffers 504*a*, 504*b* are used to select one of the odd column circuits 506 and the col.add[0:2] signals from the buffers 504*c*, 504*d* are used to select one of the even column circuits 508.

Each of the column circuits 506, 508 includes programmable logic circuitry 510 and output (level-shifting) circuitry 512. The programmable logic circuitry 510 of the column circuits 506, 508 make up pulsewidth modulation circuitry 306 (see FIGS. 2 and 3) and the output circuitry 512 of the column circuits 506, 508 make up driver circuitry 308 (see FIGS. 2 and 3). Programmable logic circuitry 510 converts the FED RGB video data supplied thereto to PWM video data. Suitable programmable logic circuitry for performing this function is a XILINX® floating gate programmable logic array (FGPLA) model XC4013XL. The programming of the FPGA may be accomplished, for example, using Verilog. Verilog is a Hardware Description Language (HDL) that allows a hardware designer to describe designs at a high level of abstraction such as at the architectural or behavioral level as well as the lower implementation levels (i.e. gate and switch levels). HDLs are used to simulate designs before the designer must commit to fabrication. Of course, the pulsewidth modulation circuitry may also be implemented using one or more Application Specific Integrated Circuit (ASIC). In one implementation, one FGPLA such as the above-mentioned XILINX® product may be provided for each 192 column lines. Thus, the FGPLA would need 192 outputs. In another implementation, a single ASIC could drive all the output circuitry 512 or one ASIC could be provided to drive the odd output circuitry and another to drive the even output circuitry.

Figure 5:
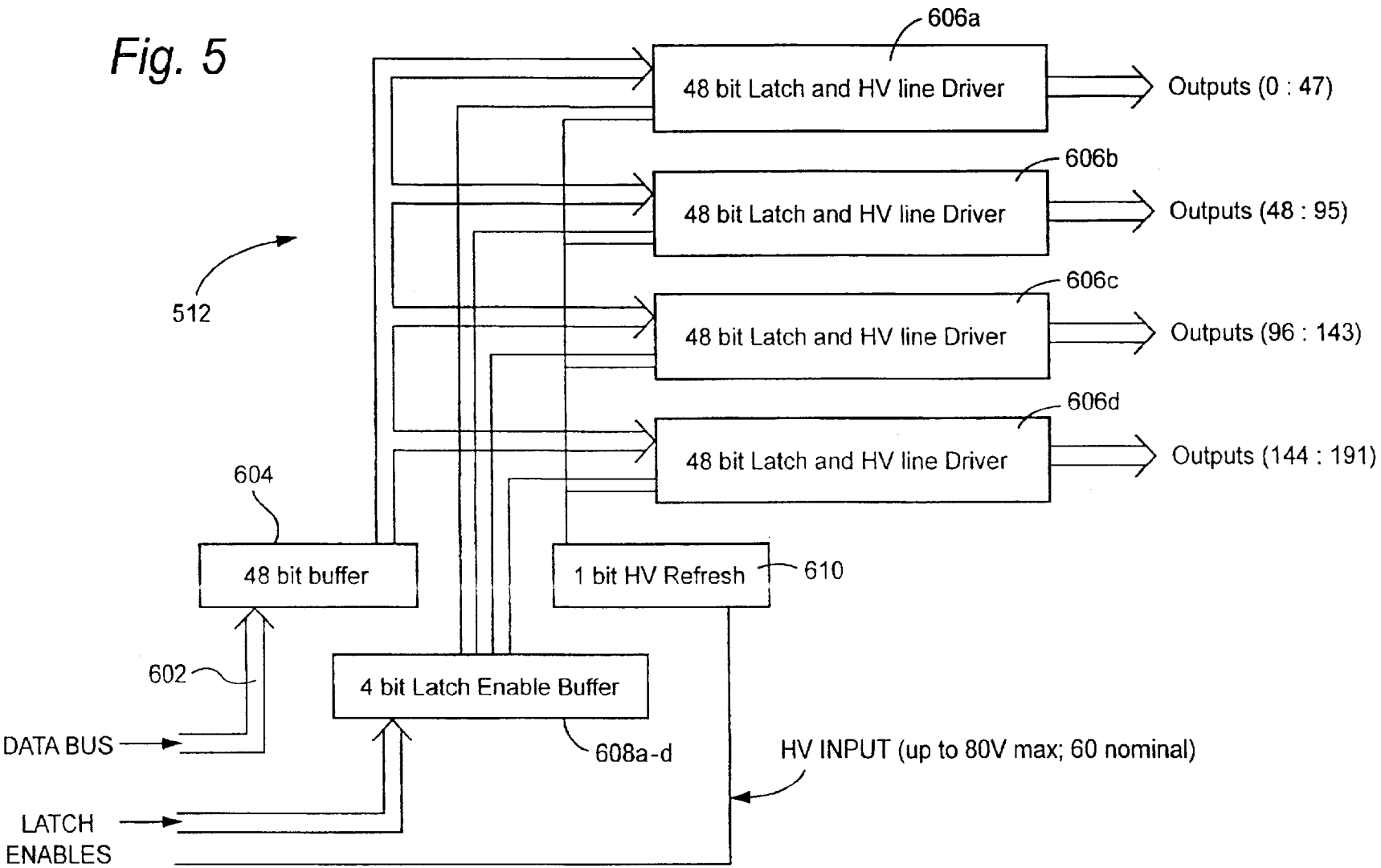
FIG. 5 is a block diagram of output circuitry 512 shown in FIG. 4.
Figure 6:
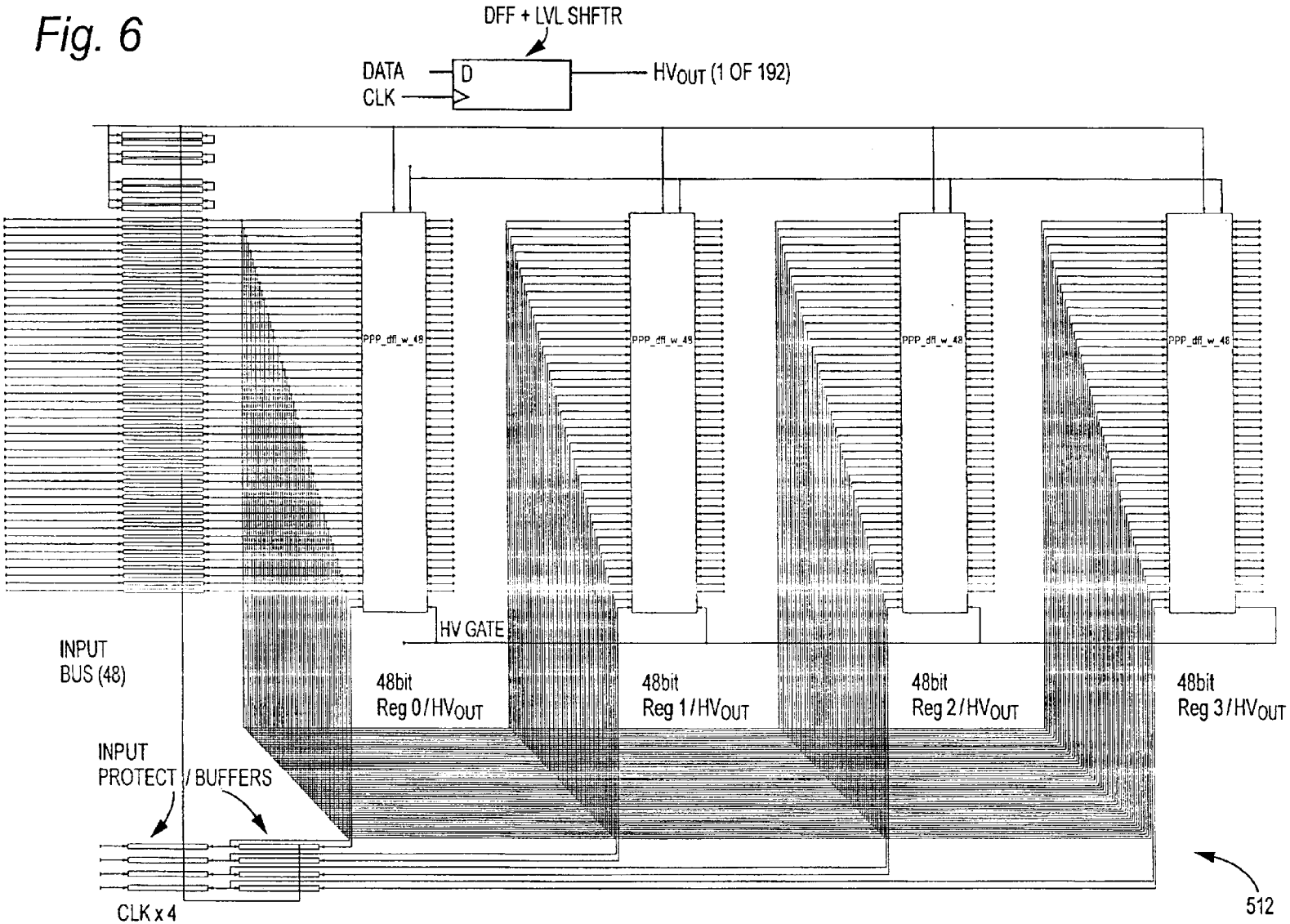
FIG. 6 is a schematic diagram of the output circuitry 512 shown in FIG. 5.
Figure 7:
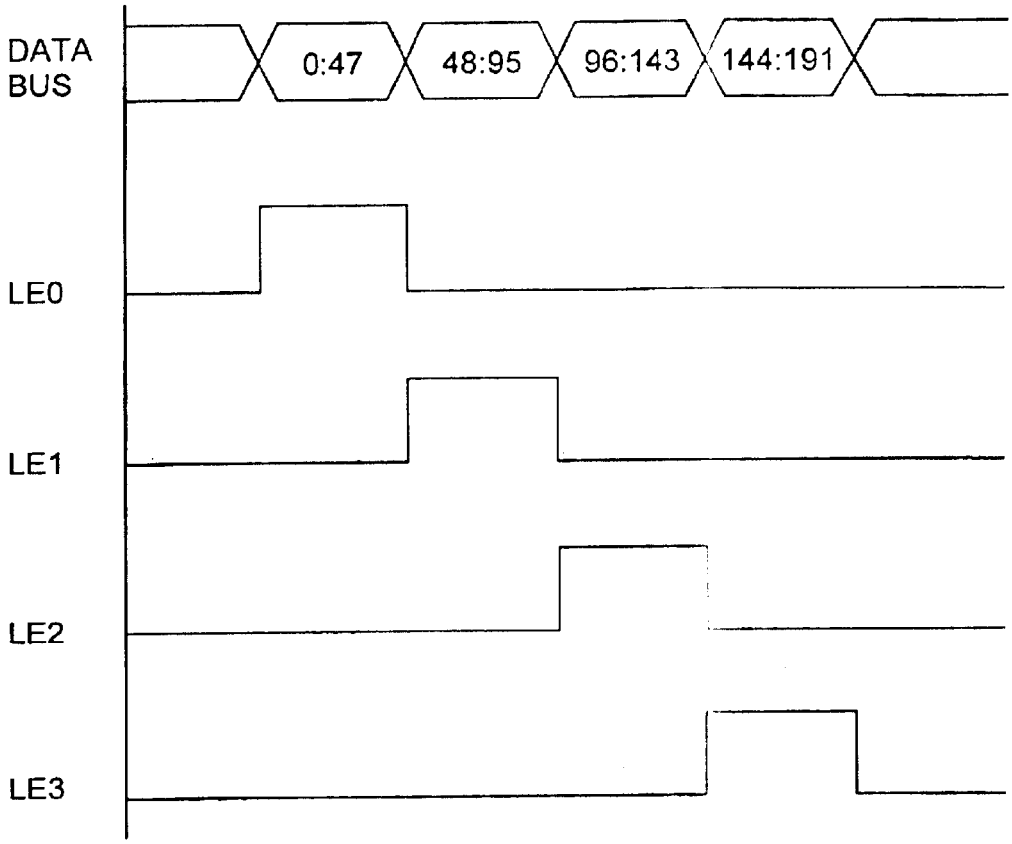
FIG. 7 is a timing diagram showing staircase pulses for clocking pulsewidth modulated video data into output circuitry 512.

Output circuitry 512 for each of the column circuits 506, 508 is shown in greater detail in FIG. 5 in which a 48-bit wide data bus 602 from the programmable logic circuitry supplies pulsewidth modulated video data to a 48-bit buffer 604. The output of the buffer 604 is supplied to one of 48-bit latch/driver circuits 606*a*, 606*b*, 606*c* and 606*d* in accordance with latch enable signals (see FIG. 7) supplied from 4 one-bit latch enable buffers 608*a–d*. Latch enable buffer 608*a* latches parallel data to latch/driver circuit 606*a*; latch enable buffer 608*b* latches parallel data to latch/driver circuit 606*b*; etc. A high voltage (HV) refresh signal from a 1-bit HV refresh buffer 610 is used to periodically refresh the outputs of latch/driver circuits 606*a*, 606*b*, 606*c* and 606*d*. The input to HV refresh buffer 610 is an HV input signal having a maximum magnitude of 80 V and a nominal magnitude of 60 V. Latch/driver circuit 606*a* provides outputs [0:47], latch/driver circuit 606*b* provides outputs [48:95], latch/driver circuit 606*c* provides outputs [96:143], and latch/driver circuit 606*d* provides outputs [144:191]. Thus, a total of 192 outputs are provided. FIG. 6 is a schematic diagram of the output circuitry 512.

In accordance with the arrangement described above, the latch/driver circuits 606*a*, 606*b*, 606*c* and 606*d* are loaded with data processed by programmable logic circuitry 510 via data bus 602. More specifically, programmable logic circuitry 510 of the column circuits 506, 508 output PWM video data that is loaded into the latch/driver circuits such that the latch/driver circuits 606*a* of all the output circuits are loaded in parallel with PWM video data in accordance with an enable signal from latch enable buffers 608*a*; the latch/driver circuits 606*b* of all the output circuits are loaded in parallel with PWM video data in accordance with an enable signal from latch enable buffers 608*b*; the latch/driver circuits 606*c* of all the output circuits are loaded in parallel with PWM video data in accordance with an enable signal from latch enable buffers 608*c*; and the latch driver circuits 606*d* of all the output circuits are loaded in parallel with PWM video data in accordance with an enable signal from latch enable buffers 608*d*.

The use of programmable logic circuitry 510 (i.e., pulsewidth modulation circuitry 306) permits the utilization of very dense logic circuitry that is "off-chip" relative to the driving circuitry. The above-described arrangement permits seven-(7) or eight-(8) bit logic processing to be performed off-chip in pulsewidth modulation circuitry 306 and this processed data is then loaded in parallel into driver circuits 606*a*, 606*b*, 606*c*, and 606*d* via data bus 602 as set forth above. The four sequences of 48 bits for each column circuit are clocked in series using the "staircase" pulses LE0, LE1, LE2 and LE3 shown in FIG. 7 for the latch enable buffers.

Programmable logic circuitry 510 enables high resolution (e.g., 8-bit resolution) to be obtained in a practical manner. With 8-bit resolution, 256 different brightness levels for the field emission display can be achieved and these different levels are outputted as different pulsewidths by programmable logic circuitry 510. For example, if each row signal of the field emission display is ON for 25.6 microseconds, programmable logic circuitry 510 can "resolve" up to 256 100-nanosecond time segments. For RGB data indicative of full brightness, programmable logic circuitry 510 generates PWM video data comprising a 255×100-nanosecond pulsewidth. For RGB data indicative of minimum brightness (other than dark), programmable logic circuitry generates PWM video data comprising a 1×100-nanosecond pulsewidth. In summary, programmable logic circuitry 510 converts video data supplied from second video circuitry 304 to a corresponding pulsewidth and then outputs the pulsewidth to the output circuitry 512. Output circuitry 512 level shifts the PWM video data and drives the corresponding column lines for a time that corresponds to the length of outputted pulsewidth.

This arrangement is superior to conventional arrangements because conventional arrangements are slow and have a large footprint (i.e., use much die space). It is difficult for prior systems using high voltage driver chips still using older (less expensive) 3 micrometer lithography semiconductor fabrication equipment to operate at high speeds. For example, the 100-nanosecond pulsewidths discussed above correspond to a 10 MHz clock speed. This clock speed is at the upper limit of the speeds that can be obtained from conventional processing on a driver chip. Even more significantly, if such a clock speed could be obtained, it would be very difficult to fit the necessary logic circuitry on the chip for providing high resolution (e.g., 7- and 8-bit resolution) displays.

Figure 8:
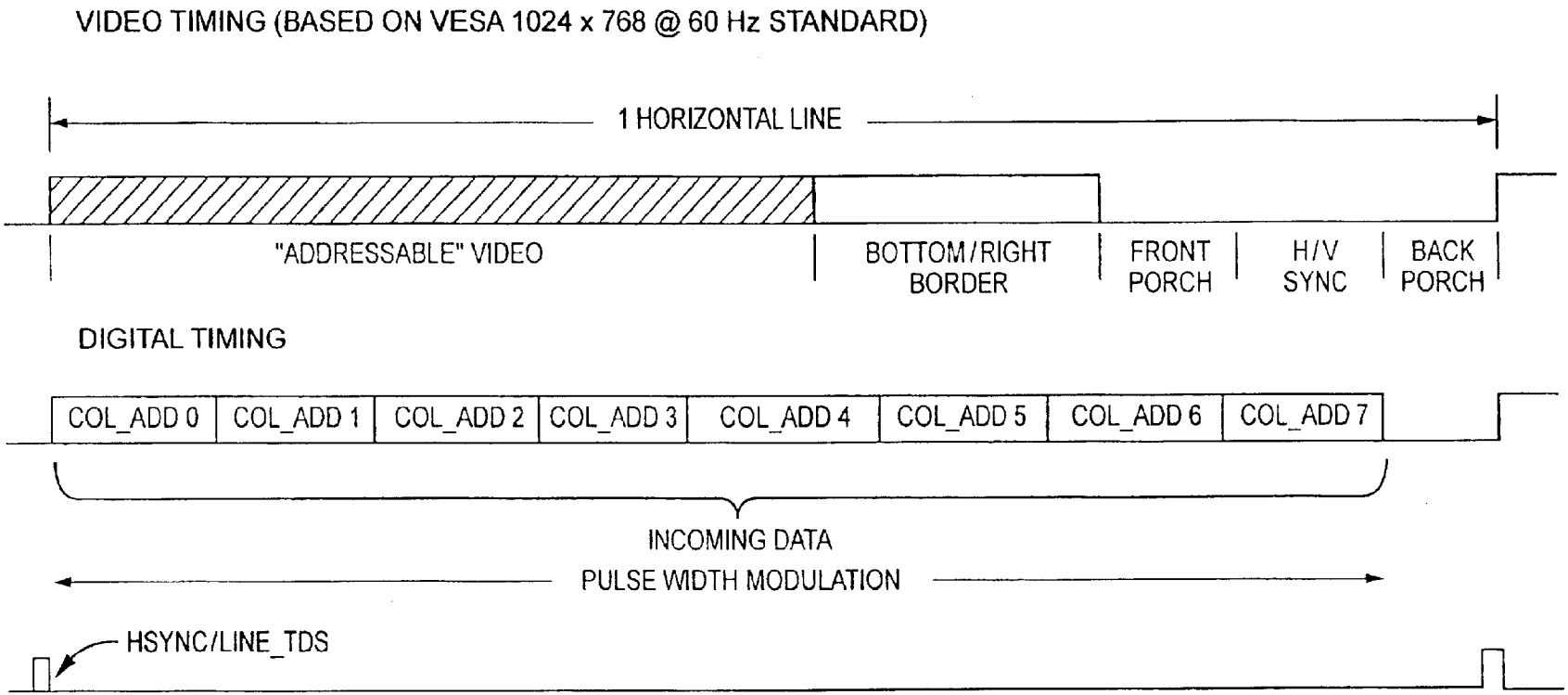
FIG. 8 is a system timing diagram.

FIG. 8 is a system timing diagram showing RGB data input and how it corresponds to digital video out. The input and output are synchronized by vertical sync and horizontal sync.

The above-described arrangement permits the use of a simplified output circuitry wherein the output circuitry for the column circuits comprises level-shifters. More specifically, with reference to FIG. 9A, each register of the 48-bit latches 606*a*, 606*b*, 606*c*, and 606*d* includes a flip-flop 902 that drives an N-channel transistor 904, the drain of the N-channel transistor 904 being the output and the source of the N-channel transistor 904 being connected to ground. A P-channel transistor 906 (a thick gate device) has a drain coupled to the output and a source connected to a voltage Vpp. A $V_{PGATE}$ signal applied to the gates of the transistors 906 in each of the registers (see FIGS. 9B and 9C) pulls all the outputs high during refresh. As shown in FIG. 9D, the $V_{DATA}$ signal supplied to the gate of the N-channel transistor 904 is a pulsewidth modulated signal in which the pulsewidth is indicative of brightness. Full bright, half-bright and minimum bright are shown in FIG. 9D. The signals supplied to N-channel transistors 904 turn the N-channel transistors OFF during refresh.

Figure 9A:
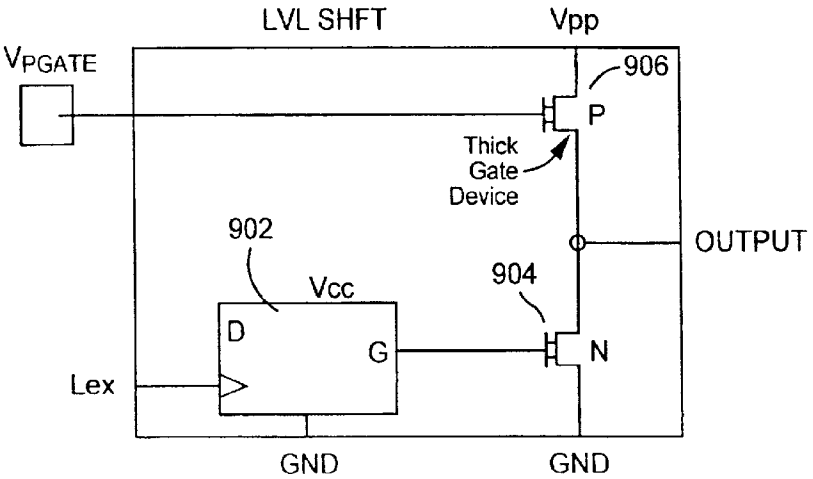
FIG. 9A illustrates a level-shifting circuit.
Figure 9B:
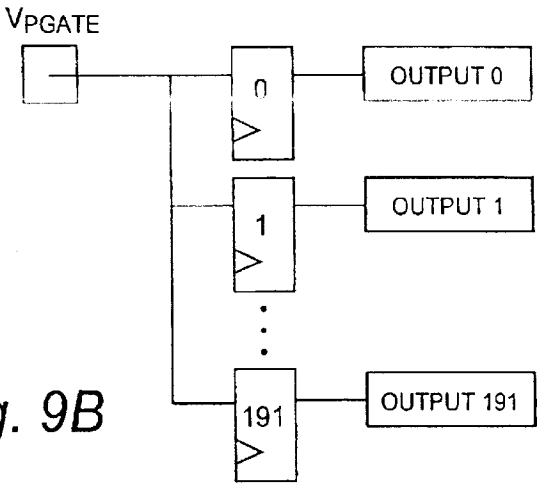
FIG. 9B illustrates the manner in which a $V_{PGATE}$ signal is applied to a plurality of level-shifting circuits.
Figure 9C:
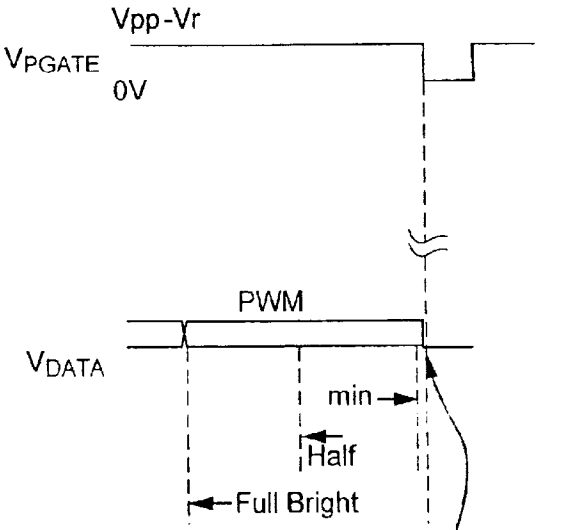
FIGS. 9C and 9D are timing diagrams for the level-shift circuits.
Figure 9D:
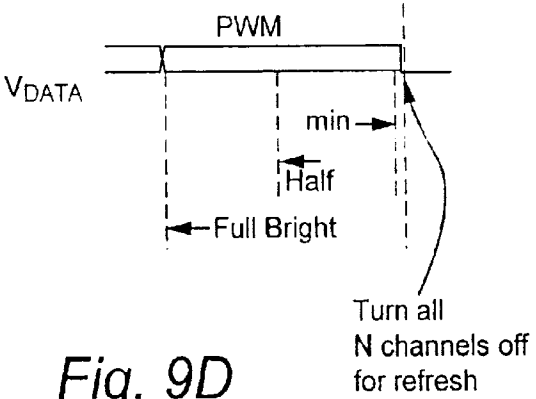

The arrangement of FIG. 9A is a simple arrangement that requires only one D-flip-flop per output. Conventional arrangements often require eight D-flip flops for each output. When double-buffering is implemented, the number of D-flip-flops increases to sixteen for each output. Thus, the above-described embodiment of the present invention clearly results in a significant simplification of the driver circuitry and a much reduced "foot-print".

Figure 10A:
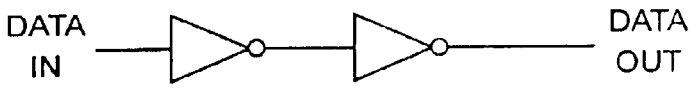
FIGS. 10A and 10B show buffers that may be used in buffer 604 of FIG.
Figure 10B:
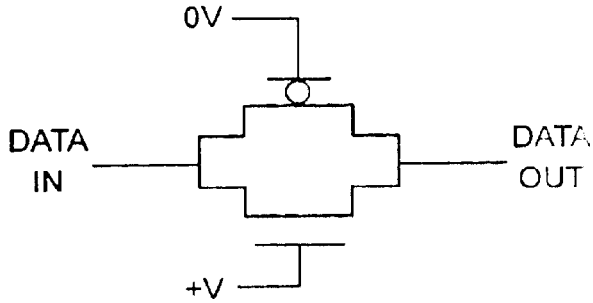

48-bit buffer 604 may comprise buffers as shown in FIGS. 10A and 10B. FIG. 10A shows CMOS inverters and FIG. 10B shows a transmission gate.

Figures 11A, 11B, 11C, 12A, 12B, 12C, 12D:
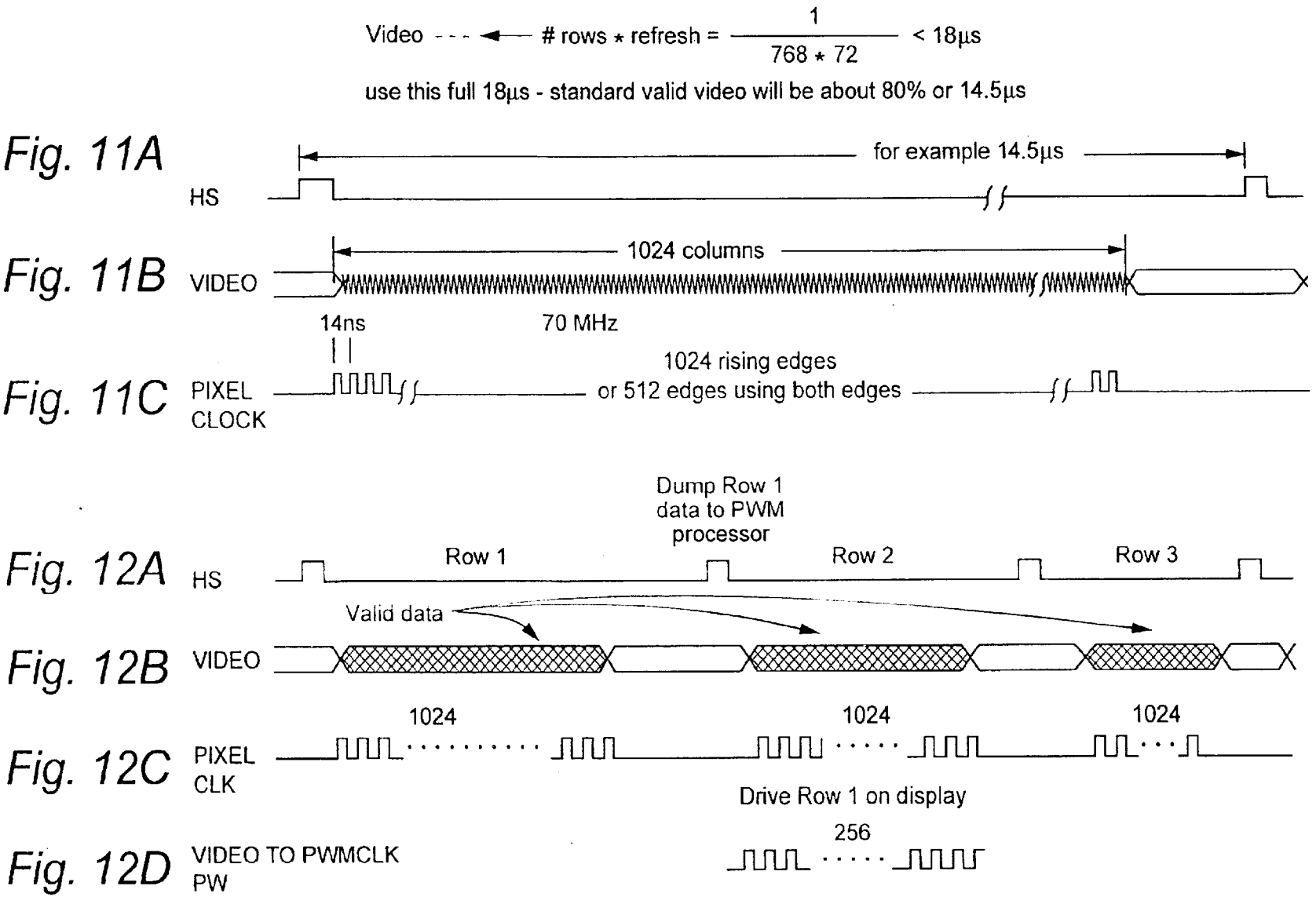
FIGS. 11A–11C show the timing for one row of a display.
FIGS. 12A–12D show the timing for three rows of a display.
Figure 13:
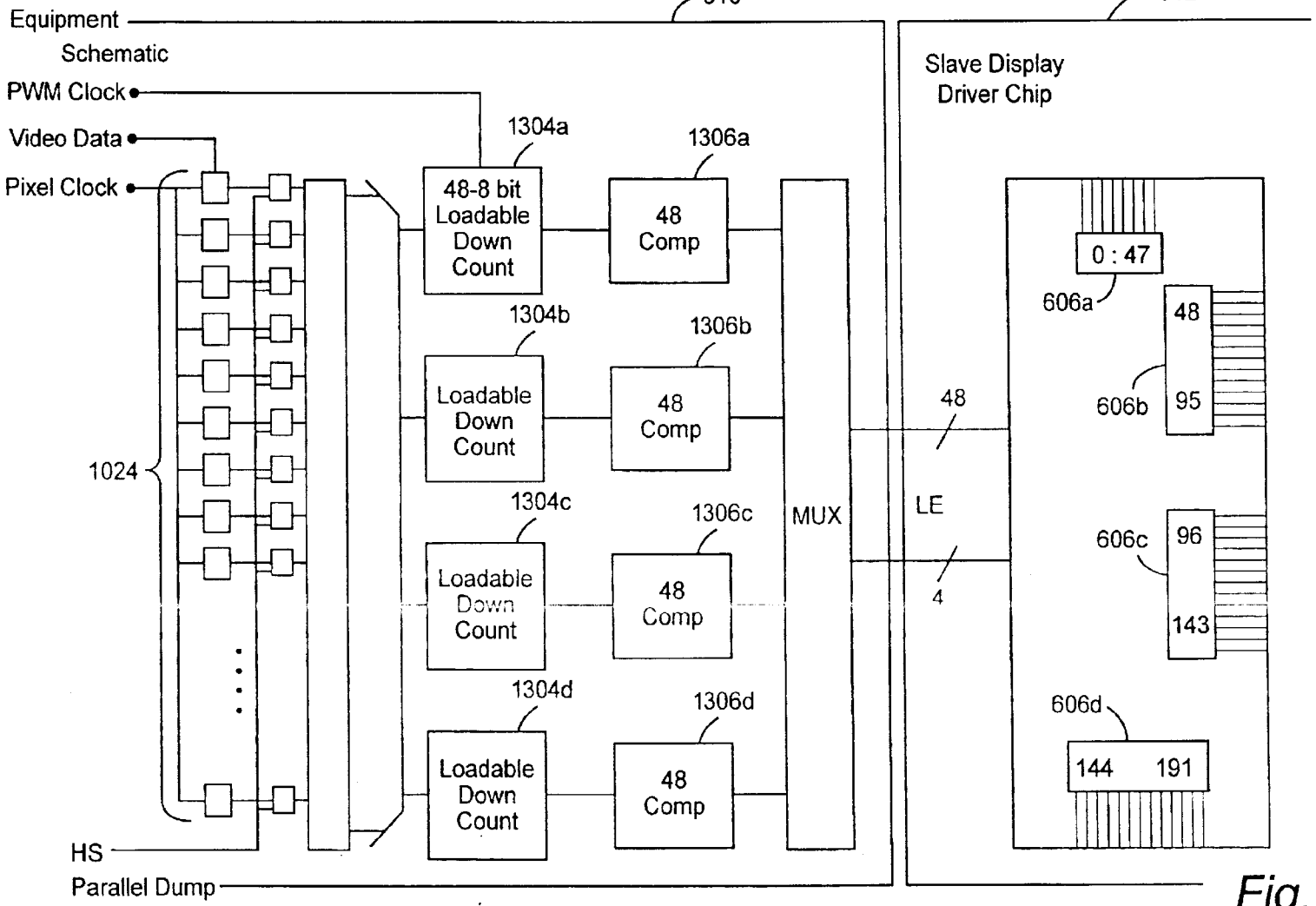
FIG. 13 is a schematic representation of programmable logic circuitry 510 and output circuitry 512.

FIGS. 11A–11C show the timing for one row of the display and FIGS. 12A–12D show the timing for three rows of the display. These timings will be discussed with reference to the schematic representation of the above-described circuitry shown in FIG. 13. 8-bit digital data is serially shifted through a serial register and supplied via parallel dumps to 8-bit loadable downcounters 1304*a*–d through inverters (not shown). The 8-bit digital data is indicative of brightness. As explained above, the 8-bit values represent the pulsewidth (in 100-nanosecond increments) of the PWM video data for each driver output for a given cycle. Thus, 00000001 represents a pulse having a 1×100 nanosecond pulsewidth and 11111111 represents a pulse having a 256× 100-nanosecond pulsewidth. The inverted bit value is indicative of the OFF time of the PWM video data for the given cycle. For example, 11111110 (obtained by inverting 00000001) indicates that the PWM video data is low for 255×100-nanoseconds. Downcounters 1304*a–d* count down to a predetermined value from the values loaded therein in accordance with a clock signal PWMCLK. During the countdown of a given downcounter, the PWM video data is low. When any respective downcounter counts down to the predetermined value (e.g., 00000000) as determined by a corresponding comparator of the comparators 1306*a–d*, the associated PWM video data goes high and remains high for the remainder of the cycle.

Of course, while inverters and downcounters are described above, it is also possible to use upcounters loaded with the 8-bit values that count up to a predetermined value (e.g., 11111111) to control the levels of the PWM video data.

Multiplexer 1308 provides 48 outputs at a time from the comparators 1306*a–d* to the driver circuits 606*a–d* via buffer 604 (not shown in FIG. 13) in accordance with the latch enable signals as described above. The clock rate of the latch enable signals is one-fourth the pixel clock rate. In the case of 8-bit values (resolution), 256 pieces of information are provided in series to each register of the driver circuits 606*a–d* during each PWM video data cycle.

In accordance with the above-described embodiment of the present invention, a high-resolution, high voltage driver for an FED is provided. The system of the invention uses programmable logic circuitry (e.g., a FPGA) having very fine line widths and gate lengths that permits high resolution displays. The function of converting RGB data into pulsewidth modulated data is programmed into the FPGA and the output of the FPGA (e.g., a pulsewidth that is an integer multiple of 100 nanoseconds) is provided to level shifters.

The above description mentions RGB data as the video source. However, the present invention is not limited to any particular video standard and is applicable to, for example, tmds, lvds, firewire, usb, and the like.

While the above description is provided with respect to a FED, the present invention is also applicable to other types of matrix type display devices such as plasma displays.

While the invention has been described in connection with certain embodiments, it is to be understood that the invention is not to be limited to these disclosed embodiments, but on the contrary, is intended to cover various modifications and equivalent arrangements included within the spirit and scope of the appended claims.

We claim:

1. A driver circuit for driving signal lines of a matrix type display device, comprising:

pulsewidth modulation circuitry for generating pulsewidth modulated video data; and driver circuitry including latch circuits for latching the pulsewidth modulated video data and driving said signal lines in accordance with the latched data, wherein output circuits each comprising at least two series-connected gate circuits are respectively associated with each of the signal lines and each latch circuit is connected to one of the gate circuits of a corresponding output circuit.

2. The driver circuit according to claim 1, wherein said driver circuitry level-shifts the pulsewidth modulated video data.

3. The driver circuit according to claim 1, wherein said pulsewidth modulation circuitry comprises a programmable logic array.

4. The driver circuit according to claim 1, wherein said pulsewidth modulation circuitry comprises an application specific integrated circuit.

5. The driver circuit according to claim 1, wherein said signal lines are connected to emitter elements of a field emission display.

6. The driver circuit according to claim 1, wherein said pulsewidth modulation circuitry generates the pulsewidth modulated video data based on RGB video data supplied thereto.

7. The driver circuit according to claim 1, wherein said driver circuitry is provided on a chip other than a chip on which said pulsewidth modulation circuitry is provided.

8. The driver circuit according to claim 1, wherein said driver circuitry comprises driver circuits that are loaded in parallel with the pulsewidth modulated video data.

9. The driver circuit according to claim 1, further comprising:

latch enable buffers.

10. The driver circuit according to claim 1, wherein the driver circuitry is supplied with one or more latch enable signals for latching the pulsewidth modulated video data.

11. A matrix type display device comprising:

display elements connected to row lines and column lines; and a driver circuit for driving said column lines, said driver circuit comprising:

pulsewidth modulation circuitry for generating pulsewidth modulated video data; and driver circuitry including latch circuits for latching the pulsewidth modulated video data and driving said column lines in accordance with the latched data, wherein output circuits each comprising at least two series-connected gate circuits are respectively associated with each of the signal lines and each latch circuit is connected to one of the gate circuits of a corresponding output circuit.

12. The matrix type display device according to claim 11, wherein said driver circuitry level-shifts the pulsewidth modulated video data.

13. The matrix type display device according to claim 11, wherein said display device is a field emission display device.

14. The matrix type display device according to claim 11, wherein said display device is a plasma display device.

15. The matrix type display device according to claim 11, wherein said pulsewidth modulation circuitry comprises a programmable logic array.

16. The matrix type display device according to claim 11, wherein said pulsewidth modulation circuitry comprises an application specific integrated circuit.

17. The matrix type display device according to claim 11, wherein said pulsewidth modulation circuitry generates the pulsewidth modulated video data based on RGB video data supplied thereto.

18. The matrix type display device according to claim 11, wherein said driver circuitry is provided on a chip other than a chip on which said pulsewidth modulation circuitry is provided.

19. The matrix type display device according to claim 11, wherein said driver circuitry comprises driver circuits that are loaded in parallel with the pulsewidth modulated video data.

20. The matrix type display device according to claim 11, wherein the driver circuitry of the driver circuit further comprises latch enable buffers.

21. The matrix type display device according to claim 11, wherein the driver circuitry of the driver circuit is supplied with one or more latch enable signals for latching the pulsewidth modulated video data.

22. A method of driving signal lines of a matrix type display device, comprising:

generating pulsewidth modulated video data;

latching the pulsewidth modulated video data into latch circuits; and driving said signal lines in accordance with the latched data, wherein the latched data is provided from the latch circuits to output circuits respectively associated with each of the signal lines, each output circuit comprising at least two series-connected gate circuits.

23. The method according to claim 22, wherein said matrix type display device is a field emission display device.

24. The method according to claim 22, wherein said matrix type display device is a plasma display device.

25. The method according to claim 22, wherein the pulsewidth modulated video data is generated based on RGB video data.

26. A driver circuit for driving signal lines of a matrix type display device, comprising:

pulsewidth modulation circuitry for generating pulsewidth modulated video data; and driver circuitry including latch circuits for latching the pulsewidth modulated video data and output transistors for driving said signal lines in accordance with the latched data, wherein said output transistors include series-connected N-channel and P-channel transistors associated with each signal line, wherein an output of a corresponding latch circuit is supplied to a control terminal of one of the N-channel and P-channel transistors.

27. The driver circuit according to claim 26, wherein a single latch circuit is provided for each signal line.

28. The driver circuit according to claim 26, further including a data buffer whose outputs are selectively latched into said latch circuits in accordance with latch enable signals.

29. A matrix type display device comprising:

display elements connected to row lines and column lines; and a driver circuit for driving said column lines, said driver circuit comprising:

pulsewidth modulation circuitry for generating pulsewidth modulated video data;

driver circuitry for level-shifting the pulsewidth modulated video data and outputting the level-shifted data as column signals to the column lines; and a data buffer for buffering the pulsewidth modulated video data and supplying the buffered data to the driver circuitry, wherein the driver circuitry comprises a plurality of multi-bit circuits, each multi-bit circuit comprising a plurality of registers, and wherein n-bits are provided in series to each register of the multi-bit circuits during a pulsewidth modulated video data cycle.

30. The matrix type display device according to claim 29, wherein respective enable signals are provided to the multi-bit circuits to load the contents of the data buffer therein.

31. The matrix type display device according to claim 30, further comprising:

an enable signal buffer for outputting the enable signals to the multi-bit circuits.

32. The matrix type display device according to claim 30, wherein the contents of the data buffer are loaded in parallel to the one of the multi-bit circuits designated by the enable signals.

33. The matrix type display device according to claim 29, wherein the registers each includes a respective flip-flop.

34. The matrix type display device according to claim 29, wherein the driver circuitry comprises four multi-bit circuits and respective enable signals are provided for sequentially loading the contents of the data buffer to each of the four multi-bit circuits.

* * * * *

UNITED STATES PATENT AND TRADEMARK OFFICE

CERTIFICATE OF CORRECTION

PATENT NO. : 6,894,665 B1
APPLICATION NO. : 09/620140
DATED : May 17, 2005
INVENTOR(S) : David A. Zimlich It is certified that error appears in the above-identified patent and that said Letters Patent is hereby corrected as shown below:

COLUMN 2, LINE 43, change "FIG." to --FIG. 5.--

Signed and Sealed this

Eighteenth Day of March, 2008

JON W. DUDAS
*Director of the United States Patent and Trademark Office*